US009493953B2

(12) United States Patent
Chabowski

(10) Patent No.: US 9,493,953 B2
(45) Date of Patent: Nov. 15, 2016

(54) ROOF COVERING ELEMENT (TILES-LIKE SHEET) EQUIPPED WITH ANGLE BRACKET

(71) Applicant: Bogdan Wiecek BUDMAT, Plock (PL)

(72) Inventor: Andrzej Chabowski, Plock (PL)

(73) Assignee: BOGDAN WIECEK BUDMAT, Plock (PL)

( * ) Notice: Subject to any disclaimer, the term of this patent is extended or adjusted under 35 U.S.C. 154(b) by 0 days.

(21) Appl. No.: 14/764,661

(22) PCT Filed: Mar. 10, 2014

(86) PCT No.: PCT/PL2014/000021
§ 371 (c)(1),
(2) Date: Jul. 30, 2015

(87) PCT Pub. No.: WO2014/142690
PCT Pub. Date: Sep. 18, 2014

(65) Prior Publication Data

US 2015/0361667 A1 Dec. 17, 2015

(30) Foreign Application Priority Data

Mar. 11, 2013 (PL) ..... 403087

(51) Int. Cl.

| | |
|---|---|
| ***E04B 2/00*** | (2006.01) |
| ***E04D 3/363*** | (2006.01) |
| ***E04D 3/30*** | (2006.01) |
| ***E04D 3/365*** | (2006.01) |
| *E04D 3/361* | (2006.01) |

(52) U.S. Cl.
CPC ..... *E04D 3/363* (2013.01); *E04D 3/30* (2013.01); *E04D 3/365* (2013.01); *E04D 2003/3617* (2013.01)

(58) Field of Classification Search
CPC ..... E04D 1/36; E04D 1/365; E04D 3/16; E04D 3/30; E04D 3/32; E04D 1/18; E04D 1/24; E04D 1/06; E04D 1/265; E04D 3/24; E04D 1/12; E04D 3/363; E04D 2003/3617
See application file for complete search history.

(56) References Cited

U.S. PATENT DOCUMENTS

| | | | |
|---|---|---|---|
| 37,450 | A | 1/1863 | Lasserre |
| 121,438 | A | 11/1871 | Wands |

(Continued)

FOREIGN PATENT DOCUMENTS

| | | | |
|---|---|---|---|
| CA | 2868563 | A1 | 10/2013 |
| CA | 2868566 | A1 | 9/2014 |

(Continued)

OTHER PUBLICATIONS

International Preliminary Report on Patentability of PCT/PL2013/000050 dated Oct. 21, 2014.

(Continued)

*Primary Examiner* — Brian Mattei
(74) *Attorney, Agent, or Firm* — Roberts Mlotkowski Safran Cole & Calderon, P.C.

(57) ABSTRACT

The roof covering element (tiles-like sheet) equipped with an angle bracket characterizes by that the ending surface (3) of the roof covering element (1), in the wave-shaped rib of the upper edge surface (2), preferably in a part without assembling hole (4), has at least one notch (5), in which is placed an angle bracket (6), and said notch (5) width is bigger than the angle bracket (6) width.

21 Claims, 8 Drawing Sheets

(56) References Cited

U.S. PATENT DOCUMENTS

Figure 1:
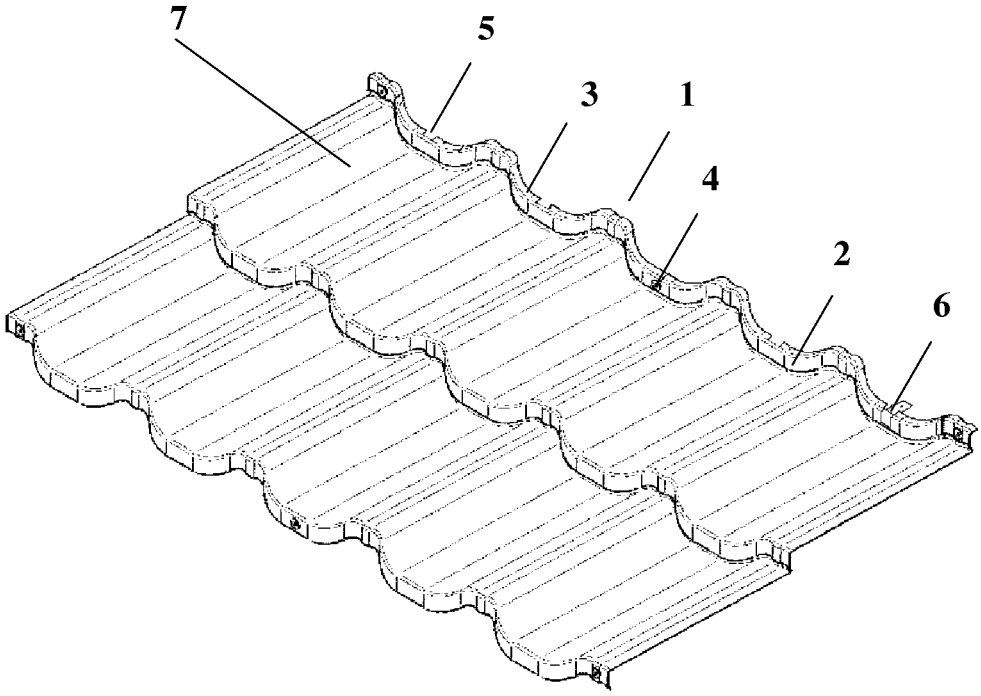

| | | | | |
|---|---|---|---|---|
| 737,078 | A | 8/1903 | Chapman | |
| 805,884 | A | 11/1905 | Satterlee | |
| 1,386,130 | A | 8/1921 | Herbert et al. | |
| 1,491,015 | A | 4/1924 | McFarland | |
| 1,658,591 | A | 2/1928 | Dorn | |
| 1,729,946 | A | 10/1929 | Kuehn | |
| 1,816,439 | A | 7/1931 | Masters | |
| 1,913,342 | A | 6/1933 | Schaffert | |
| 1,914,876 | A | 6/1933 | Workman | |
| 1,955,699 | A | 4/1934 | Moffit | |
| 2,076,989 | A | 4/1937 | Andres et al. | |
| 2,424,410 | A | 7/1947 | Miles | |
| 2,486,168 | A | 10/1949 | Jurasevich | |
| 2,685,852 | A | 8/1954 | Godel | |
| 2,737,267 | A | 3/1956 | Koch | |
| 3,269,075 | A | 8/1966 | Cosden et al. | |
| 3,754,366 | A * | 8/1973 | Jansson | E04D 3/30 52/533 |
| 3,760,545 | A | 9/1973 | Pearse et al. | |
| 3,897,667 | A | 8/1975 | Turek | |
| 4,001,997 | A * | 1/1977 | Saltzman | E04D 3/32 52/521 |
| 4,102,106 | A * | 7/1978 | Golder | E04F 13/0864 52/533 |
| 4,133,161 | A | 1/1979 | Lester | |
| 4,178,731 | A | 12/1979 | Petersson | |
| 4,262,462 | A | 4/1981 | Melbye | |
| 4,554,773 | A | 11/1985 | Conley | |
| 4,592,185 | A * | 6/1986 | Lynch | E04D 1/265 52/314 |
| 4,598,522 | A * | 7/1986 | Hoofe, III | E04D 1/265 52/555 |
| 4,616,465 | A | 10/1986 | Byers et al. | |
| 4,617,773 | A * | 10/1986 | Studwell | E04D 3/30 52/535 |
| 5,752,355 | A | 5/1998 | Sahramaa | |
| 5,878,543 | A * | 3/1999 | Mowery | E04F 13/0864 52/519 |
| 6,269,604 | B1 * | 8/2001 | Pedersen | E04D 3/365 52/537 |
| RE38,210 | E | 8/2003 | Plath et al. | |
| 7,316,099 | B2 | 1/2008 | Faulkner et al. | |
| 7,690,169 | B2 | 4/2010 | Saarenko et al. | |
| 7,980,036 | B2 | 7/2011 | Takayasu et al. | |
| 8,291,664 | B2 | 10/2012 | Hanig | |
| 2005/0102930 | A1 * | 5/2005 | Saarenko | E04D 1/06 52/198 |
| 2007/0144097 | A1 * | 6/2007 | Saarenko | E04D 3/30 52/539 |
| 2010/0132275 | A1 | 6/2010 | Stanger | |
| 2011/0146199 | A1 | 6/2011 | Ferrante et al. | |
| 2011/0154767 | A1 * | 6/2011 | Perttula | E04D 1/265 52/518 |
| 2015/0113902 | A1 * | 4/2015 | Chabowski | E04D 3/24 52/519 |
| 2015/0275519 | A1 | 10/2015 | Chabowski | |
| 2015/0361667 | A1 | 12/2015 | Chabowski | |

FOREIGN PATENT DOCUMENTS

| | | | |
|---|---|---|---|
| CA | 2870817 | A1 | 10/2014 |
| DE | 2157284 | A1 | 5/1972 |
| EA | 201401301 | A1 | 3/2015 |
| EA | 201401131 | A1 | 6/2015 |
| EA | 201401302 | A1 | 6/2015 |
| EP | 2839090 | A1 | 2/2015 |
| FR | 2824856 | A1 | 11/2002 |
| GB | 203132 | A | 9/1923 |
| JP | 11124964 | | 5/1999 |
| NL | 7712976 | A | 9/1978 |
| PL | 339424 | A1 | 12/2000 |
| PL | 206210 | B1 | 12/2004 |
| PL | 379919 | | 12/2007 |
| PL | 396691 | A1 | 4/2013 |
| PL | 398857 | A1 | 10/2013 |
| PL | 403087 | A1 | 9/2014 |
| PL | 403552 | A1 | 10/2014 |
| WO | 99/16985 | A1 | 4/1999 |
| WO | 9916985 | A1 | 4/1999 |
| WO | 01/11160 | A1 | 2/2001 |
| WO | 2006018472 | A1 | 2/2006 |
| WO | 2009/056683 | A1 | 5/2009 |
| WO | 2013157968 | A1 | 10/2013 |
| WO | 2014/142690 | A1 | 9/2014 |
| WO | 2014171845 | A1 | 10/2014 |

OTHER PUBLICATIONS

International Preliminary Report on Patentability of PCT/PL2013/000099 dated Oct. 20, 2015.

International Preliminary Report on Patentability of PCT/PL2014/000021 dated Sep. 15, 2015.

Office Action for U.S. Appl. No. 14/432,746 dated Aug. 3, 2015; 11 Pages.

Notice of Allowance for U.S. Appl. No. 14/394,612 dated Jun. 10, 2015; 5 Pages.

International Search Report of International Application No. PCT/PL2014/000021 mailed Jun. 30, 2014.

International Search Report of International Application No. PCT/PL2013/000050 mailed Jul. 15, 2013.

International Search Report of International Application No. PCT/PL2013/000099 mailed Dec. 18, 2013.

* cited by examiner

ROOF COVERING ELEMENT (TILES-LIKE SHEET) EQUIPPED WITH ANGLE BRACKET

The present invention relates to a roof covering element (tiles-like sheet) equipped with an angle bracket.

The roof covering element made of a board material, comprising the first and second side edges, upper and lower edges, is known from the patent application description no. P396691. The element has series of modules substantially done parallel to the side edges, creating upper and lower plane. The modules have two or more wave-shaped ribs stretched parallel to the upper and lower edges. One of the ribs is done in the lower edge in form of profiled bends folded beneath the roof covering element. The lower bend is at the right angle to the lower plane. Upper part of the lower bend links with the lower plane by an arch. Lower part of the lower bend ends as an arched slant directed beneath the roof covering element. The roof covering element has the upper rib, which cross-section is in form of the upper bend at the right angle to the upper plane and to the ending plane of the roof covering element. Lower part of the upper bend forms a semicircular deflection folded outwards the roof covering element and which links with the upper plane. Upper part of the upper bend links with the ending plane of the roof covering plane by an arch.

From the Polish patent application P398857, there is also known the roof covering element (tiles-like sheet) equipped with embossments, and it characterises in that the surface of the lower edge of the roof covering element has at least one embossment done toward underside of the roof covering element with an assembling hole prepared centrally. A bottom of the embossment is at zero or acute angle with the surface of the lower edge. The surface of the upper edge of the roof covering element has at least one embossment done outwards of the roof covering element with an assembling hole prepared centrally. A bottom of the embossment is at zero or acute angle with the surface of the upper edge.

The roof covering element (tile-like sheet) equipped with an angle bracket according to the invention characterises in that the ending surface of the roof covering element, in the wave-shaped rib of the upper edge surface, preferably in a part without assembling hole, has at least one notch, of preferably rectangular shape, in which is placed an angle bracket. The notch width is bigger than the angle bracket width.

Preferably, a section done by doubled cuts of the ending surface is bent towards the upper edge from the side of endings surface and it adjoins to the upper edge.

Preferably, a horizontal part of the angle bracket has at least one hole.

Preferably, a frontal part of the angle bracket is parallel to the back part.

Preferably, the frontal part of the angle bracket and the back part produce an acute angle.

Preferably, the frontal part and the back part of the angle bracket produce a right or open angle.

Preferably, the frontal part of the angle bracket has a bottom edge being straight and parallel to the horizontal part of the angle bracket. Between the back part and the horizontal part of the angle bracket there is a camber, which shape corresponds to a semicircular deflection of the roof covering element.

Preferably, the frontal part of the angle bracket has a bottom edge ended with a slant directed outwards, beyond surface of the frontal part of the angle bracket.

Preferably, there is a rib between the back part and the horizontal part of the angle bracket.

Preferably, the preferably frontal part of the angle bracket has a bottom edge ended with a slant, which is between the frontal part and the back part of the angle bracket. The frontal part and back part of the angle bracket are connected together with a horizontal connector.

Preferably, the frontal part of the angle bracket has a bottom edge ended with a slant, which is located between the frontal part and the bottom part of the back part of the angle bracket parallel to the frontal part of the angle bracket. The upper part of the back part of the angle bracket produce an acute angle with the frontal part of the angle bracket.

The roof covering element (tile-like sheet) equipped with an angle bracket according to the invention provides efficient assembling of the sheets to the roof battens without commonly used holes done in the horizontal surfaces of the panels. There are no metal chips being a corrosion centre. Number of used angle brackets depends on predicted roof burden with different forces. A notch for an angle bracket done in an ending surface with a slant section provides additional the bracket protection from contact with a sharp edge which would appear after removing of the section.

Figure 2:
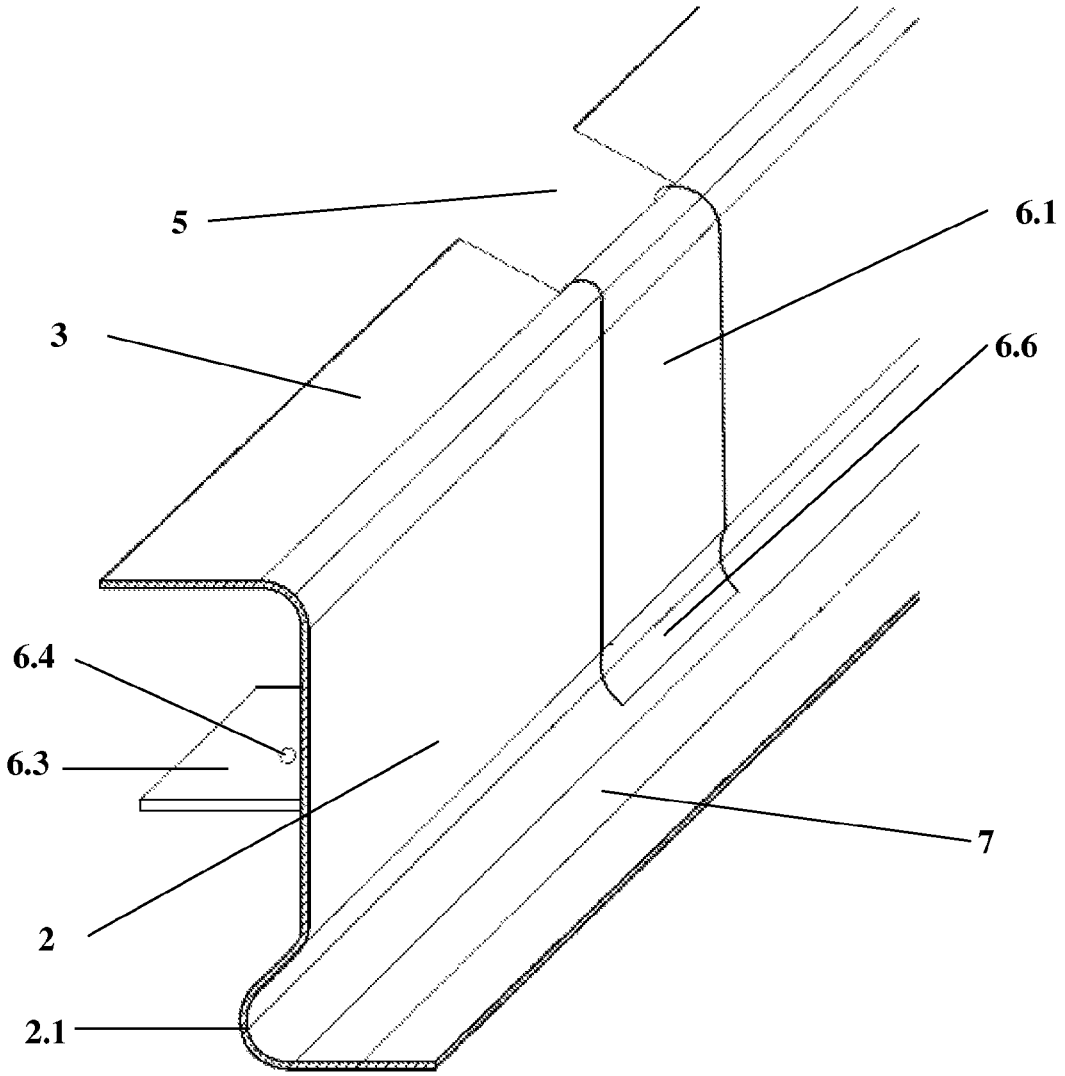
Figure 3:
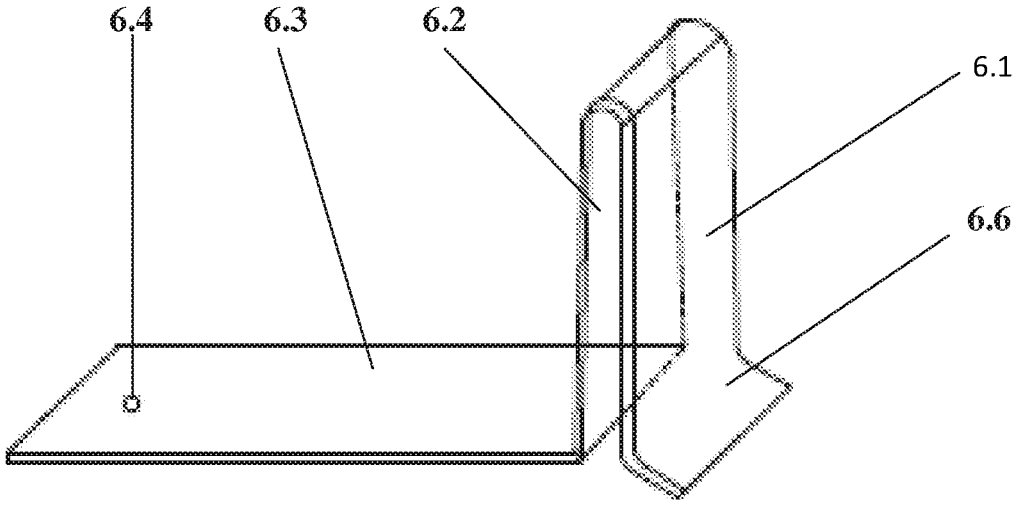
Figure 4:
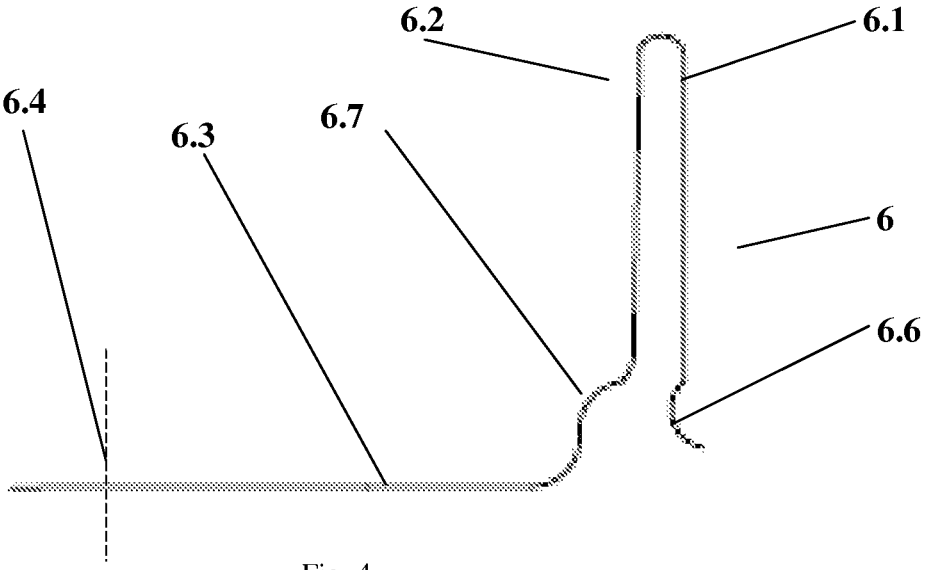
Figure 5:
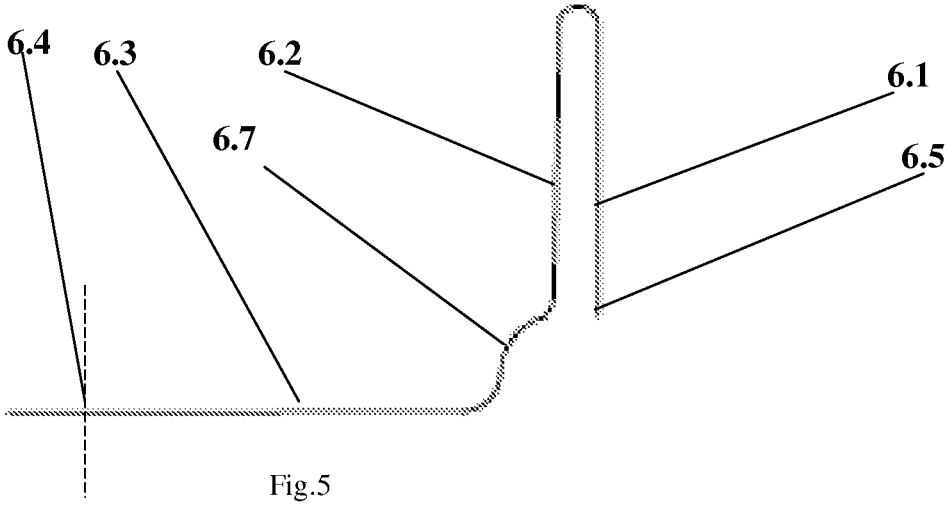
Figure 6:
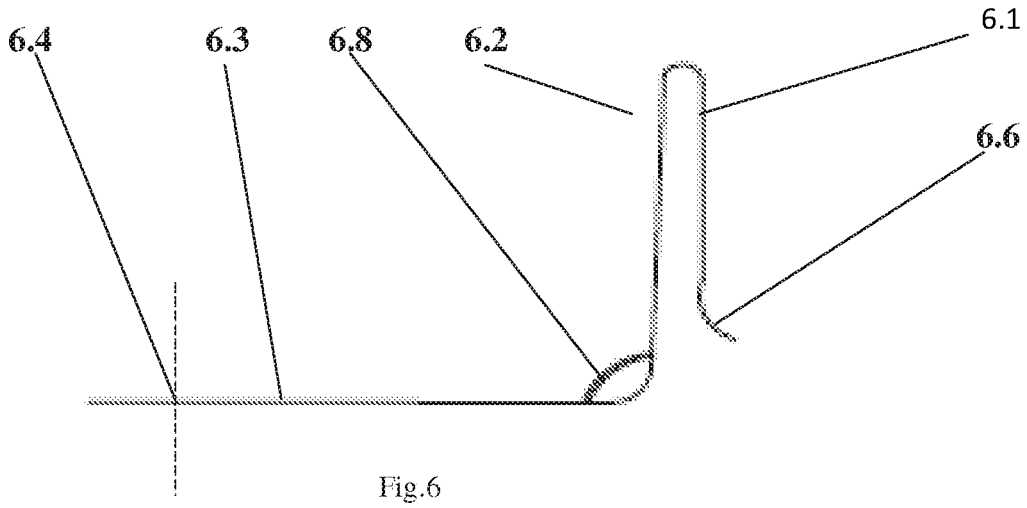
Figure 7:
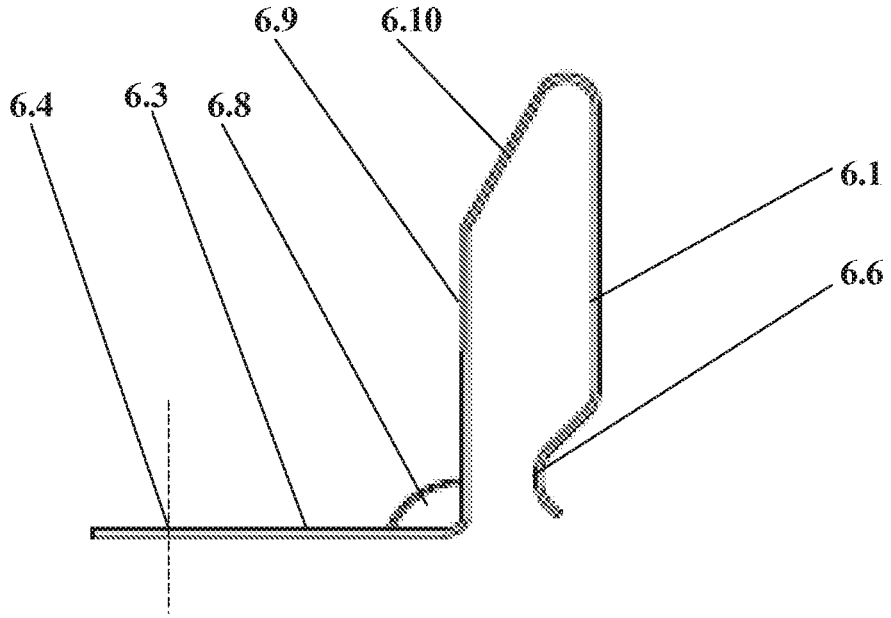
Figure 8:
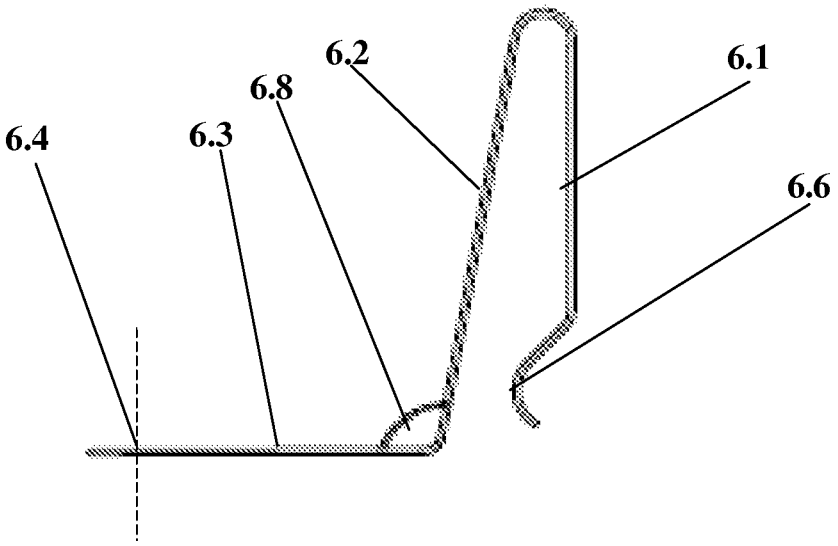
Figure 9:
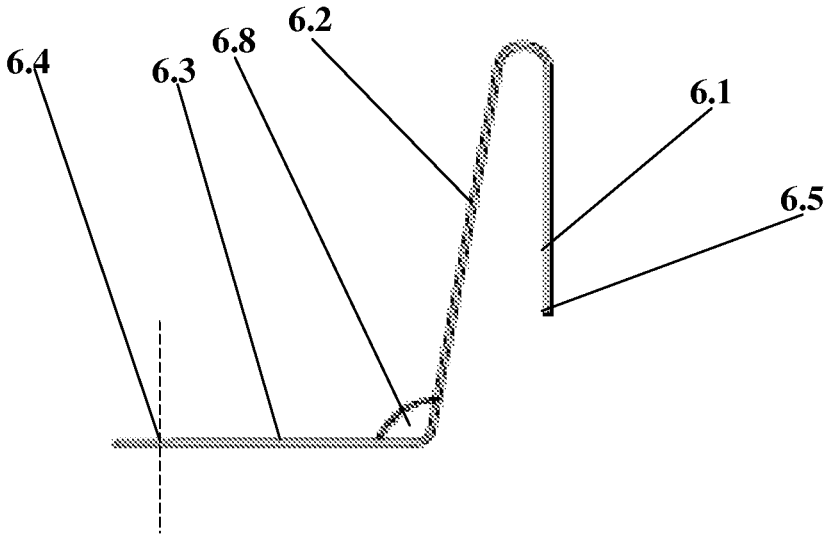
Figure 10:
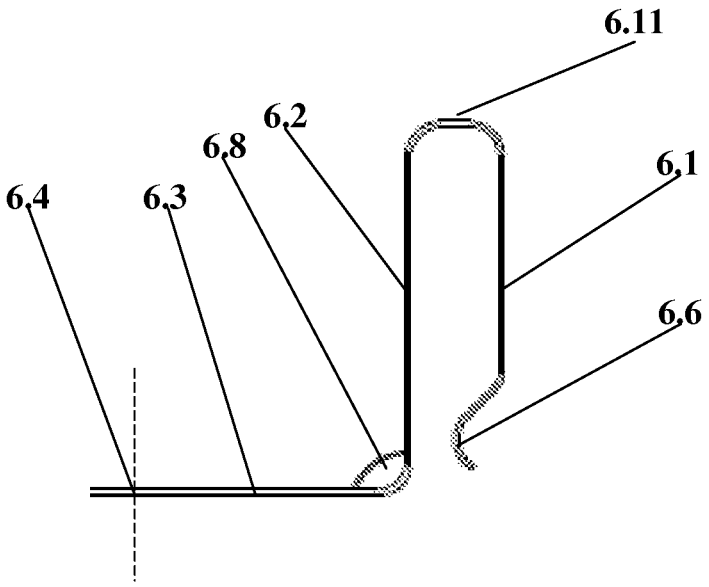
Figure 11:
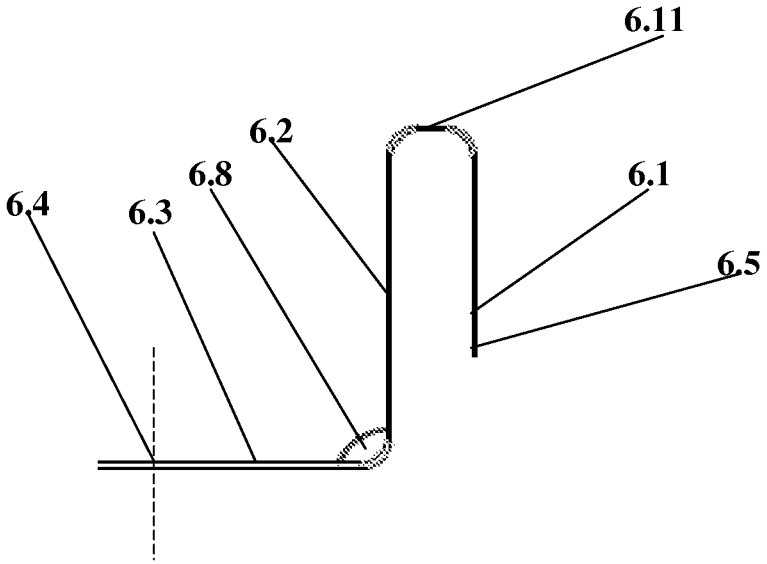
Figure 12:
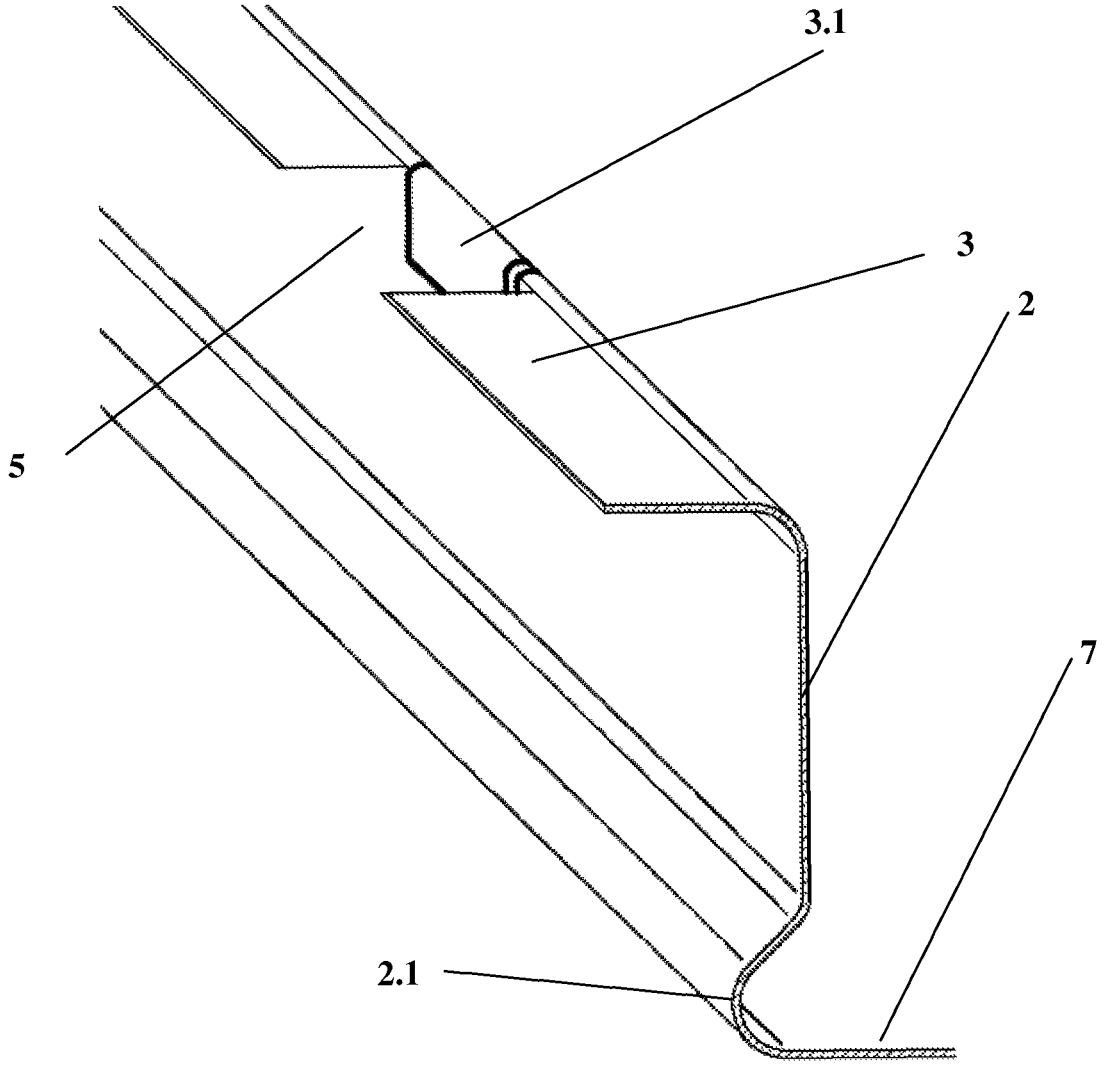

The subject of the invention is presented in exemplary embodiments in drawings on which FIG. 1 illustrates the roof covering (tiles-like sheet) equipped with angle bracket according to the invention in axonometric view, FIG. 2 shows the angle bracket on the roof covering element (tiles-lie sheet) according to the invention in axonometric view, FIG. 3 the angle bracket in axonometric view, FIG. 4 to FIG. 11 show side view of different embodiments of the angle bracket, FIG. 12 demonstrates axonometric view of a notch with a slant section in the roof covering element (tiles-like sheet) according to the invention.

The roof covering element (tiles-like sheet) equipped with an angle bracket according to the invention characterises in that the ending surface 3 of the roof covering element 1, in the wave-shaped rib of the upper edge surface 2, preferably in a part without assembling hole 4, has at least one notch 5, f preferably rectangular shape, in which is placed an angle bracket 6, The notch 5 width is bigger than the angle bracket 6 width.

In other embodiment of the notch 5, preferably a section 3.1, done by doubled cuts of the ending surface 3, is bent towards the upper edge 2 from the side of endings surface 3 and it adjoins to the upper edge 2.

Preferably horizontal part 6.3 of the angle bracket 6 has at least one hole 6.4.

Preferably frontal part 6.1 of the angle bracket 6 is parallel to back part 6.2, and in other embodiment the frontal part 6.1 of the angle bracket 6 and the back part 6.2 produce an acute angle.

Preferably back part 6.2 and the horizontal part 6.3 of the angle bracket 6 produce a right or open angle.

In other embodiment the frontal part 6.1 of the angle bracket 6 has bottom edge 6.5 being straight and parallel to the horizontal part 6.3 of the angle bracket 6, whilst between the back part 6.2 and the horizontal part 6.3 of the angle bracket 6 there is a camber 6.7, which shape corresponds to a semicircular deflection 2.1 of the roof covering element 1.

In other embodiment the frontal part 6.1 of the angle bracket 6 has a bottom edge 6.5 ended with a slant 6.6 directed outwards, beyond surface of the frontal part 6.1 of the angle bracket 6.

In other embodiment frontal part 6.1 of the angle bracket 6 has a bottom edge 6.5 ended with a slant 6.6 directed outwards, beyond surface of the frontal part 6.1 of the angle bracket 6, whilst between the back part 6.2 and the horizontal part 6.3 of the angle bracket 6 there is a camber 6.7, which shape corresponds to a semicircular deflection 2.1 of the roof covering element 1.

In other embodiment the frontal part 6.1 of the angle bracket 6 has a bottom edge 6.5 ended with a slant 6.6, directed outwards, beyond surface of the frontal part 6.1 of the angle bracket 6, whilst there is a rib 6.8 between the back part 6.2 and the horizontal part 6.3 of the angle bracket 6.

In other embodiment the frontal part 6.1 of the angle bracket 6 has a bottom edge 6.5 ended with a slant 6.6, which is between the frontal part 6.1 and the back part 6.2 of the angle bracket 6, and there is a rib 6.8 between the back part 6.2 and horizontal part 6.3 of the angle bracket 6, whilst the frontal part 6.1 and back part 6.2 of the angle bracket 6 are connected with a horizontal connector 6.11.

In other embodiment the frontal part 6.1 of the angle bracket 6 has a bottom edge 6.5 being straight and parallel to the horizontal part 6.3 of the angle bracket 6, and there is a rib 6.8 between the back part 6.2 and the horizontal part 6.3 of the angle bracket 6, whilst the frontal part 6.1 and back part 6.2 of the angle bracket 6 are connected with a horizontal connector 6.11.

In one more embodiment the frontal part 6.1 of the angle bracket 6 has a bottom edge 6.5 ended with a slant 6.6, which is located between the frontal part 6.1 and the bottom part 6.9 of the back part 6.2 of the angle bracket 6 parallel to the frontal part 6.1 of the angle bracket 6. The upper part 6.10 of the back part 6.2 of the angle bracket 6 produce an acute angle with the frontal part 6.1 of the angle bracket 6. There is a rib 6.8 between bottom part 6.9 of the back part 6.2 and horizontal part 6.3 of the angle bracket 6.

The angle bracket 6 is positioning in the notch 5 performed in the ending surface 3 in the way that there is fragment of the upper edge 2 between the frontal part 6.1 and back part 6.2 of the angle bracket 6. The frontal part 6.1 of the angle bracket 6 is from the side of the upper wavy plane 7 of the roof covering element 1. The horizontal part 6.3 of the angle bracket 6, being outside the roof covering element 1, is placed on a roof batten. Using the hole 6.4 in the horizontal part 6.3 of the angle bracket 6, the angle bracket 6 is mounted to a roof batten with a tap screw and at the same time the roof covering element 1 is mounted to a roof batten as well. Number of used angle brackets 6 depends on predicted roof burden with different forces.

A LIST OF SYMBOLS ON DRAWINGS

1 roof covering element
2 upper edge
2.1 semicircular deflection
3 ending surface
3.1 section
4 assembling hole
5 notch
6 angle bracket
6.1 frontal part
6.2 back part
6.3 horizontal part
6.4 hole
6.5 bottom edge
6.6 edge slant
6.7 camber
6.8 rib
6.9 bottom part
6.10 upper part
6.11 connector
7 upper wavy plane

The invention claimed is:

1. A roof covering element comprising embossments having side edges, upper and lower edges, a series of modules formed parallel to the side edges forming upper and lower planes, wave-shaped ribs extending parallel to the upper and lower edges, a rib in the lower edge in the form of a profiled bend having an upper part that links with the lower plane, a rib in the upper edge in the form of a second profiled bend having its upper part linked with an ending plane and its lower part linked with the upper plane, a surface of the lower edge having an assembling hole centrally located therein a surface of the upper edge having an embossment formed outward from the roof covering element and having an assembling hole centrally located therein wherein an ending surface of the roof covering element in the wave-shaped rib of the upper edge surface has at least one notch, in which is placed an angle bracket, and said notch width is bigger than the angle bracket width.

2. The roof covering element according to claim 1 wherein the notch is rectangular.

3. The roof covering element according to claim 2 wherein a frontal part of the angle bracket has a bottom edge being straight and parallel to a horizontal part of the angle bracket, and there is a rib between a back part and the horizontal part of the angle bracket.

4. The roof covering element according to claim 2 wherein a frontal part of the angle bracket has a bottom edge terminating with a slant, which is located between the frontal part and a bottom part of a back part of the angle bracket parallel to the frontal part of the angle bracket, and an upper part of the back part of the angle bracket produce an acute angle with the frontal part of the angle bracket, and there is a rib between the bottom part of the back part and a horizontal part of the angle bracket.

5. The roof covering element according to claim 1 wherein a section formed by doubled cuts of the ending surface is bent towards the upper edge from sides of the ending surface and it adjoins the upper edge.

6. The roof covering element according to claim 1 wherein a horizontal part of the angle bracket has at least one hole.

7. The roof covering element according to claim 6 wherein a frontal part of the angle bracket has a bottom edge terminating with a slant, which is located between the frontal part and a bottom part of a back part of the angle bracket parallel to the frontal part of the angle bracket, and an upper part of the back part of the angle bracket produce an acute angle with the frontal part of the angle bracket, and there is a rib between a bottom part of the back part and horizontal part of the angle bracket.

8. The roof covering element according to claim 1 wherein a frontal part of the angle bracket is parallel to a back part.

9. The roof covering element according to claim 1 wherein a frontal part of the angle bracket and a back part produce an acute angle.

10. The roof covering element according to claim 1 wherein a back part and a horizontal part of the angle bracket produce a right angle.

11. The roof covering element according to claim 1 wherein a back part and a horizontal part of the angle bracket produce an open angle.

12. The roof covering element (tiles-like sheet) according to claim 1 wherein a frontal part of the angle bracket has a bottom edge being straight and parallel to a horizontal part of the angle bracket, and between a back part and the horizontal part of the angle bracket there is a camber, which shape corresponds to a semicircular deflection of the roof covering element.

13. The roof covering element according to claim 1 wherein a the frontal part of the angle bracket has a bottom edge terminating with a slant directed outwards, beyond a surface of the frontal part of the angle bracket.

14. The roof covering element according to claim 1 wherein a frontal part of the angle bracket has a bottom edge terminating with a slant directed outwards, beyond a surface of the frontal part of the angle bracket, and between a back part and a horizontal part of the angle bracket there is a camber, which shape corresponds to a semicircular deflection of the roof covering element.

15. The roof covering element according to claim 1 wherein a frontal part of the angle bracket has a bottom edge terminating with a slant directed outwards, beyond a surface of the frontal part of the angle bracket, and there is a rib between a back part and a horizontal part of the angle bracket.

16. The roof covering element according to claim 1 wherein a frontal part of the angle bracket has a bottom edge terminating with a slant, which is between the frontal part and a back part of the angle bracket, and there is a rib between the back part and a horizontal part of the angle bracket, and the frontal part and back part of the angle bracket are connected with a horizontal connector.

17. The roof covering element according to claim 1 wherein a frontal part of the angle bracket has a bottom edge being straight and parallel to a horizontal part of the angle bracket, and there is a rib between a back part and the horizontal part of the angle bracket, and the frontal part and back part of the angle bracket are connected with a horizontal connector.

18. The roof covering element according to claim 1 wherein a frontal part of the angle bracket has a bottom edge terminating with a slant, which is located between the frontal part and a back part of the angle bracket, and there is a rib between the back part and a horizontal part of the angle bracket.

19. The roof covering element according to claim 1 wherein a frontal part of the angle bracket has a bottom edge being straight and parallel to a horizontal part of the angle bracket, and there is a rib between a back part and the horizontal part of the angle bracket.

20. The roof covering element according to claim 1 wherein a frontal part of the angle bracket has a bottom edge terminating with a slant, which is located between the frontal part and a bottom part of a back part of the angle bracket parallel to the frontal part of the angle bracket, and an upper part of the back part of the angle bracket produce an acute angle with the frontal part of the angle bracket, and there is a rib between the bottom part of the back part and a horizontal part of the angle bracket.

21. The roof covering element according to claim 1 wherein the notch is in the wave-shaped rib of the upper edge surface in a part without an assembling hole.

* * * * *